US008216093B2

(12) United States Patent
Chen

(10) Patent No.: US 8,216,093 B2
(45) Date of Patent: Jul. 10, 2012

(54) STRENGTHENED SUPPORT STRUCTURE FOR A NET POST ASSEMBLY USED IN BALL GAMES

(76) Inventor: Michael Chen, Taichung (TW)

( * ) Notice: Subject to any disclaimer, the term of this patent is extended or adjusted under 35 U.S.C. 154(b) by 224 days.

(21) Appl. No.: 12/783,533

(22) Filed: May 19, 2010

(65) Prior Publication Data

US 2011/0287873 A1 Nov. 24, 2011

(51) Int. Cl.
*A63B 61/04* (2006.01)

(52) U.S. Cl. ..... 473/492; 473/490

(58) Field of Classification Search ..... 473/490, 473/491, 492, 493, 494
See application file for complete search history.

(56) References Cited

U.S. PATENT DOCUMENTS 4,010,951 A * 3/1977 Gronlund ..... 473/492
4,274,632 A * 6/1981 Jacobs ..... 473/492
6,716,123 B1 * 4/2004 Chen ..... 473/490

* cited by examiner

*Primary Examiner* — Nini Legesse

(57) ABSTRACT

A strengthened support structure for a net post assembly used in ball games comprises a plurality of lower support units disposed between two lateral support rod assemblies thereof, and each of the lower support units includes a first support section, a second support section, and a support body. The first support section and the second support section are connected to define an angle therebetween, and the support body is connected to the free ends of the first support section and the second support section. Each of the lower support units acts as an independent stress-sharing structure, so that stress can be equally distributed over the lower support units. The angle defined between the first support section and the second support section cooperate with the support body to strengthen the structural strength of the respective lower support units, which maintains the distance between the two lateral support rod assemblies constant.

10 Claims, 10 Drawing Sheets

STRENGTHENED SUPPORT STRUCTURE FOR A NET POST ASSEMBLY USED IN BALL GAMES

BACKGROUND OF THE INVENTION

1. Field of the Invention

The present invention relates to a net post assembly, and more particularly to a strengthened support structure for a net post assembly used in ball games.

2. Description of the Prior Art

Sports games including running, swimming, or ball games have become many people's after-work recreations, and most of the ball games normally require a net to be set up in the playing field, and the net is also used as a kind of marking criteria. Therefore, the position that the net post assembly is to be set must conform to standards.

As shown in FIG. 1, a net 11 of a conventional net post assembly 10 has two ends inserted on lateral support rods 121 at both sides of a support rack 12. To prevent the net getting loose and prevent the two lateral support rods 121 from moving toward each other when being pulled by the net 11, a lower support rod assembly 13 is disposed between the two lateral support rods 121 of the net post assembly 10. The lower support rod assembly 13 includes a plurality of rods 131 that are telescopically connected together, and then an elastic rope 132 is inserted in the lower support rod assembly 13, both ends of the elastic rope 132 are filmed with a knot 133 which is fastened to a plug 134 connected to the bottom of the lateral support rods 121, so that the lower support rod assembly 13 are positioned between the two lateral support rods 121 to keep the lateral support rods 121 at a constant distance.

Since the lower support rod assembly 13 is a long straight and fiat assembly formed by connecting the plurality of rods 131 together, it is likely to sag down in the middle due to its own weight or when subjected to an external stress, and as a result, the distance between the two lateral support rods 121 will change, and the net post assembly 10 won't meet the design standard.

The present invention has arisen to mitigate and/or obviate the afore-described disadvantages.

SUMMARY OF THE INVENTION

The primary object of the present invention is to provide a strengthened support structure for a net post assembly used in ball games, which is capable of maintaining the distance between the two lateral support assemblies of the net post assembly constant, while keeping the net in an appropriately tensioned condition.

To achieve the above object, a strengthened support structure for a net post assembly used in ball games, comprises:

two lateral support rod assemblies being oppositely arranged and spaced by a distance, between the two lateral support rod assemblies being disposed a net; and a plurality of lower support units each including a first support section and a second support section and a support body, a first end of the first support section being connected to a first end of the second support section to define an angle between the first and the second support sections, and a second end of the first support section being connected to one end of the support body and a second end of the second support section being connected to another end of the support body, the lower support units being connected in series in such a manner that the second end of the first support section of one of the lower support units is connected to the second end of the second support section of another lower support unit, a first one of the plural connected lower support units has a second end connected to a lower end of one of the lateral support rod assemblies, and a last one of the plural connected lower support units has a second end connected to a lower end of the other of the later support rod assemblies.

With the lower support units disposed at the bottom of the net, the two lateral support rod assemblies can be stably propped up. Furthermore, each of the lower support units acts as an independent stress-sharing structure, so that stress can be equally distributed over the lower support units. The angle defined between the first support section and the second support section cooperate with the support body to strengthen the structural strength of the respective lower support units, which maintains the distance between the two lateral support rod assemblies constant.

DETAILED DESCRIPTION OF THE PREFERRED EMBODIMENTS

Figure 1:
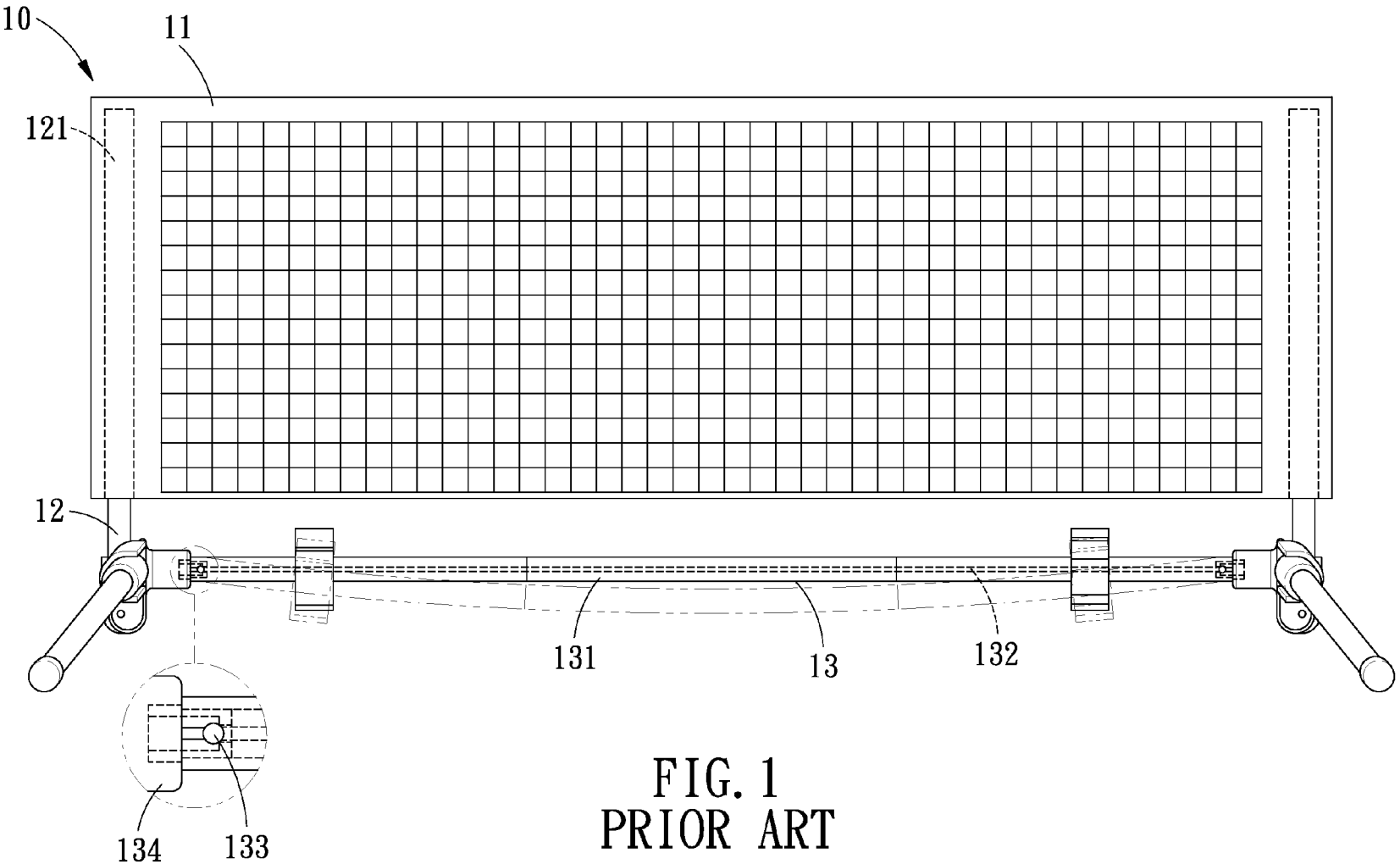
FIG. 1 PRIOR ART
FIG. 1 is an illustrative view of a conventional net post assembly.
Figure 2:
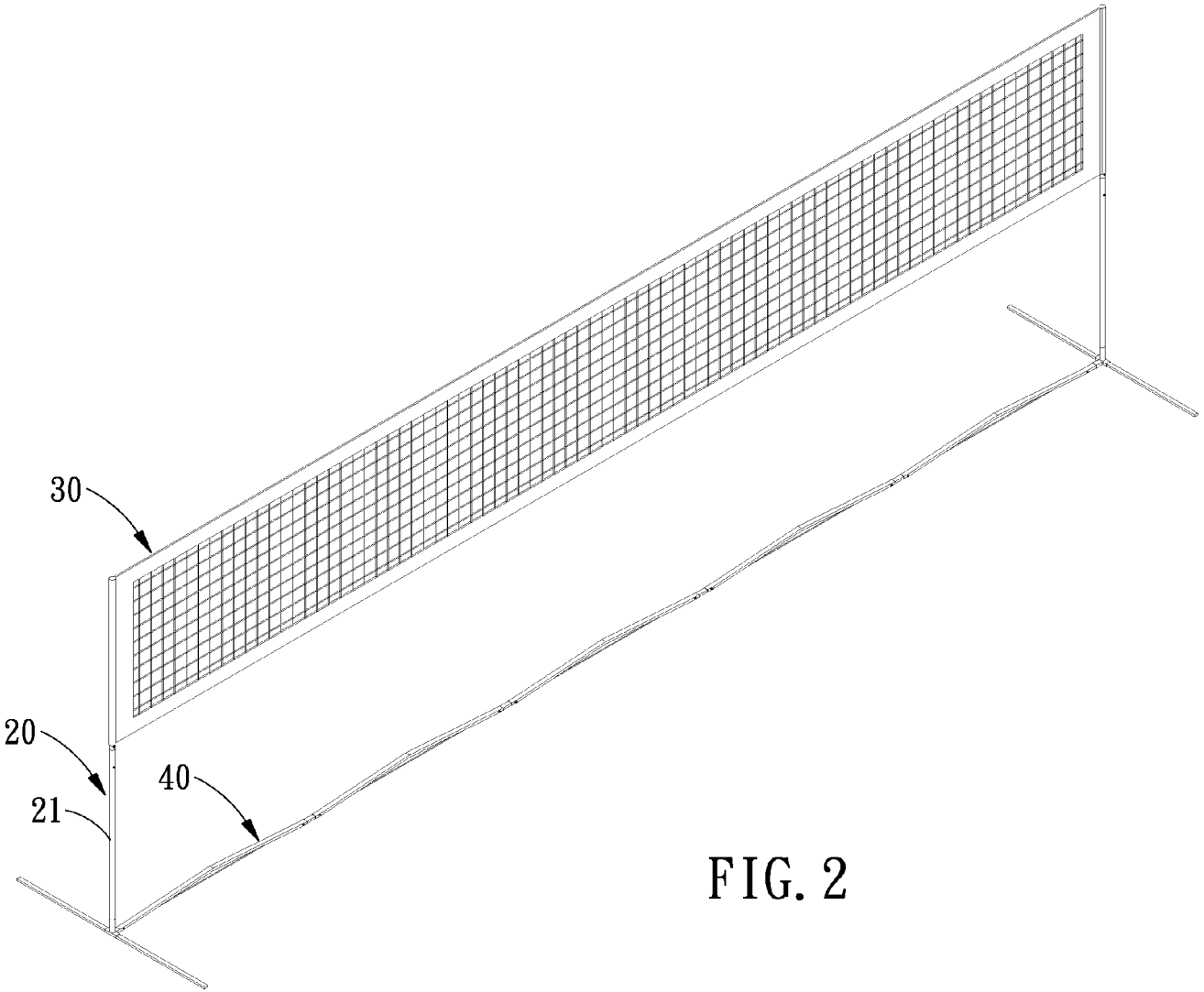
FIG. 2 is a perspective view of a strengthened support structure for a net post assembly used in ball games in accordance with a preferred embodiment of the present invention.

The present invention will be clearer from the following description when viewed together with the accompanying drawings, which show, for purpose of illustrations only, the preferred embodiment in accordance with the present invention.

Referring to FIGS. 2-8, a strengthened support structure for a net post assembly used in ball games in accordance with a preferred embodiment of the present invention comprises: two lateral support rod assemblies 20, and a plurality of lower support units 40.

The two lateral support rod assemblies 20 are oppositely arranged and spaced by a distance, and between the two lateral support rod assemblies 20 is provided a net 30. Each of the lateral support rod assemblies 20 includes a plurality of connected rods 21 and is further provided with a support seat 22 at a lower end thereof. Each of the support seats 22 includes four support pipes 221 that are in communication with one another, and one of the four support pipes 221 of each of the support seats 22 vertically extends upwards to be connected to the lower end of the lateral support rod assemblies 20, and the remained three support pipes 221 are connected together into T shape at the lower end of the vertical support pipe 221 in such a manner that two of the support pipes 221, the angle between which is 180°, are connected to two lower support rods 23, and the remained one is connected to the lower support unit 40. The support seats 22, the rods 21 and the lower support rods 23 are connected by an elastic rope A. The net 30 has two inserting portions 31 at both ends thereof inserted on the upper ends of the lateral support rod assemblies 20.

The lower support units 40 are hollow pipes which are connected one another and disposed on the support seats 22 of the two lateral support rod assemblies 20. Each of the lower support units 40 includes a first support section 41 and a second support section 42 and a support body 43. A first end of the first support section 41 is connected to a first end of the second support section 42 to define an angle between the first and the second support sections 41, 42, and a second end of the first support section 41 is connected to one end of the support body 43 and a second end of the second support section 42 connected to another end of the support body 43 to make the respective lower support units 40 form into an arch shape. The lower support units 40 are connected in series in such a manner that the second end of the first support section of one of the lower support units is connected to the second end of the second support section of another lower support unit. The second end of the first support section 41 is formed with a hollow engaging portion 411. The second end of the second support section 42 is formed with an inserting head 421 corresponding to the engaging portion 411. The first support section 41 is formed with a hole 412, and the second support section 42 is formed with a hole 422. The support body 43 in the present embodiment is a steel rope, and it can also be any rope which is not made of steel or can be a rod. A first one of the plural connected lower support units 40 has a second end connected to the lower end of one of the lateral support rod assemblies 20, and a last one of the plural connected lower support units 40 has a second end connected to the lower end of the other of the later support rod assemblies 20.

Figure 3:
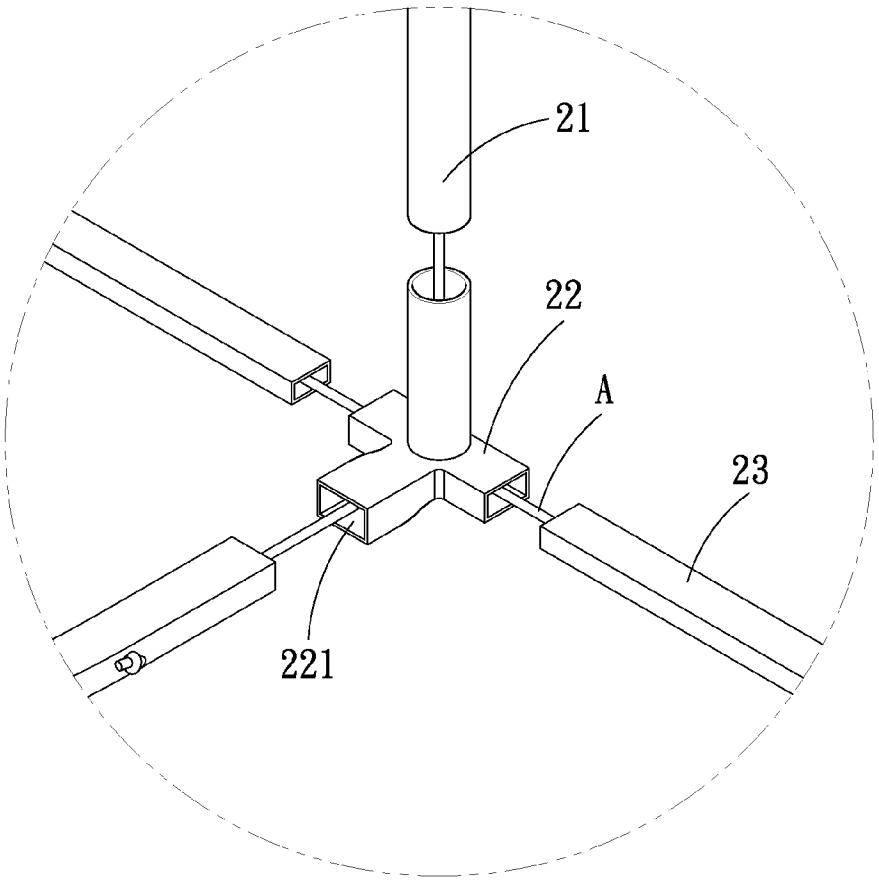
FIG. 3 is an exploded view of a part of the strengthened support structure for the net post assembly used in ball games in accordance with the present invention.
Figure 4:
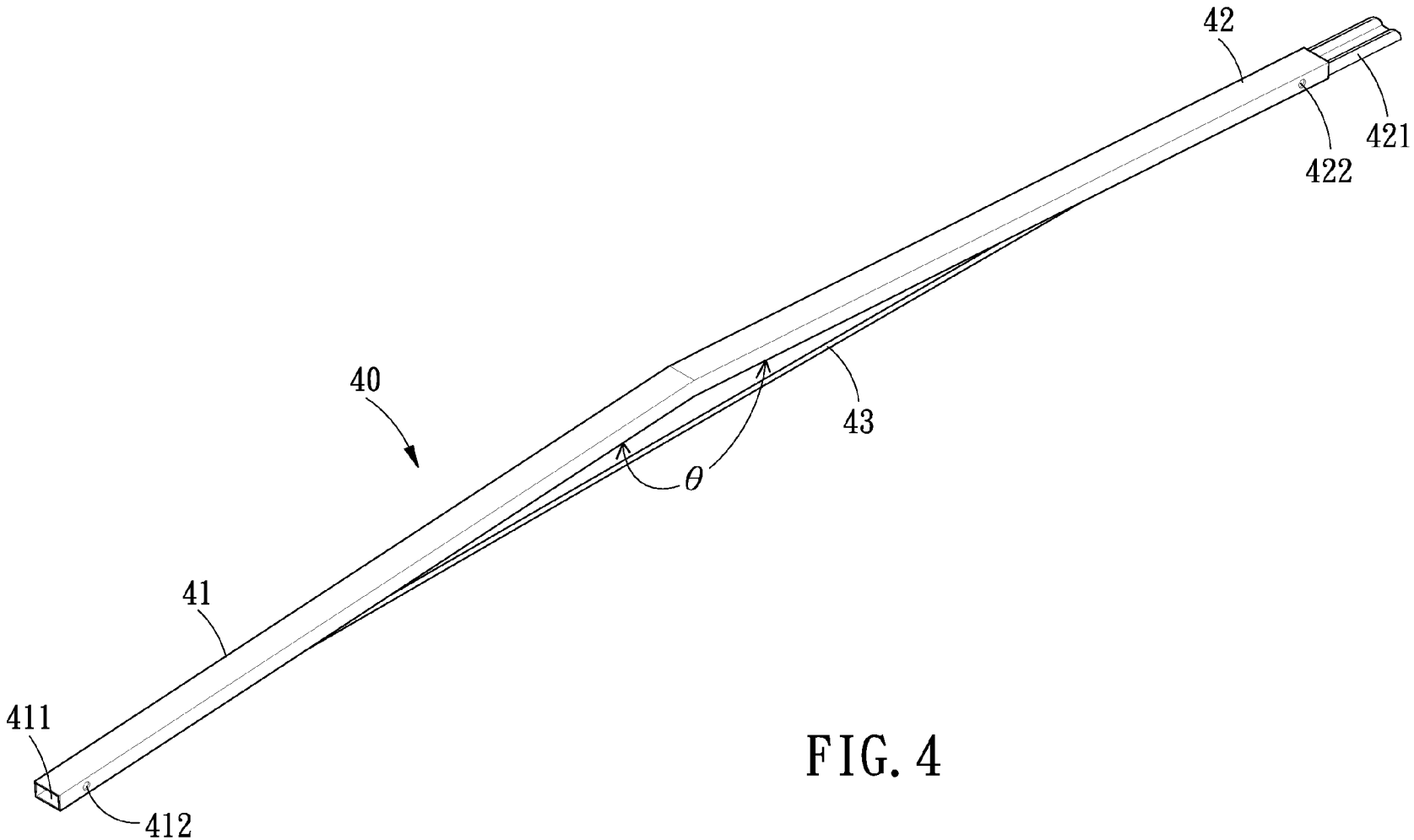
FIG. 4 is an amplified view of another part of the strengthened support structure for the net post assembly used in ball games in accordance with the present invention.
Figure 5:
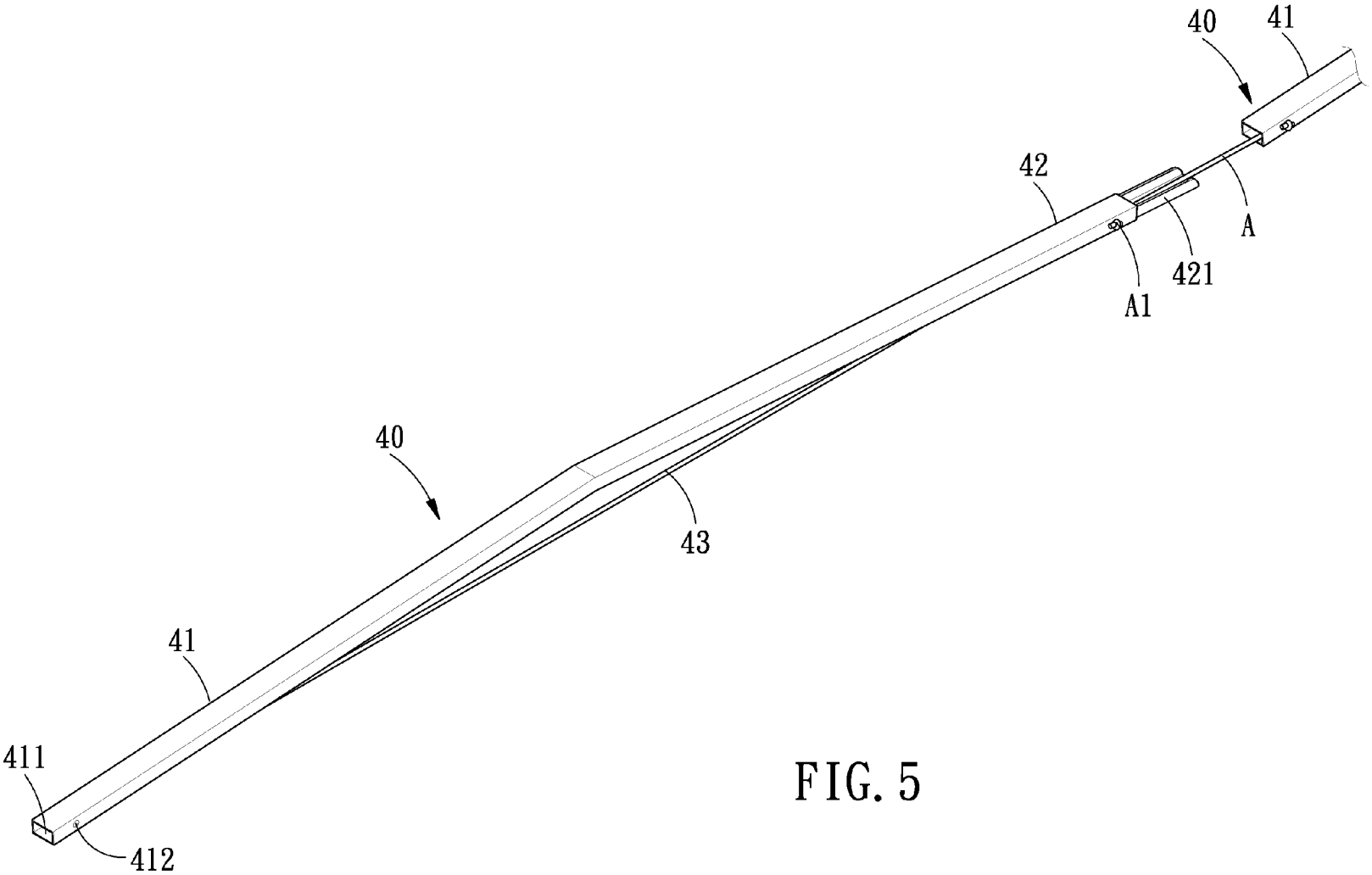
FIG. 5 is an illustrative of the present invention showing that two lower support units are connected.
Figure 6:
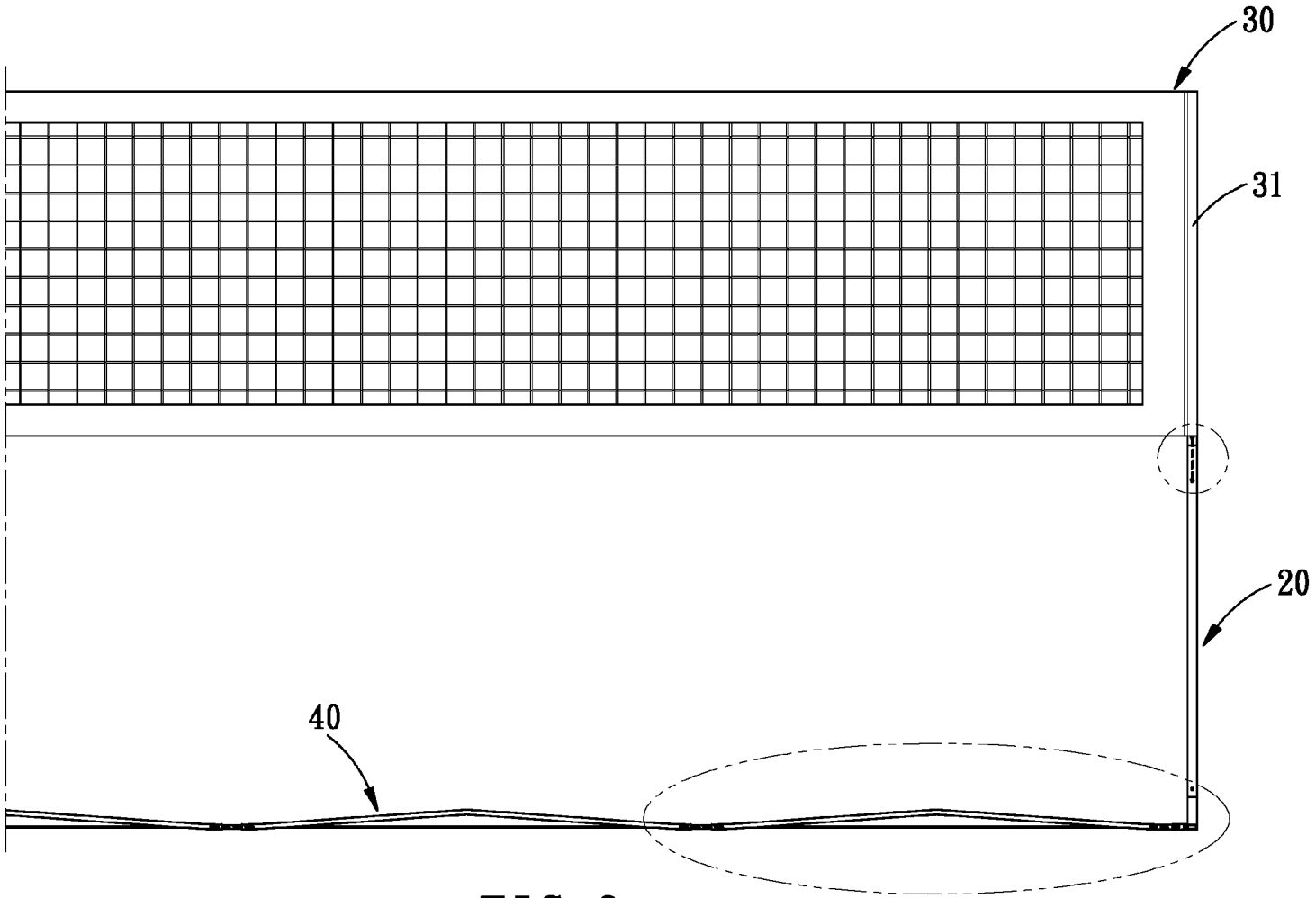
FIG. 6 is a plan view of the present invention showing that the net is set up on the net post assembly.
Figure 7:
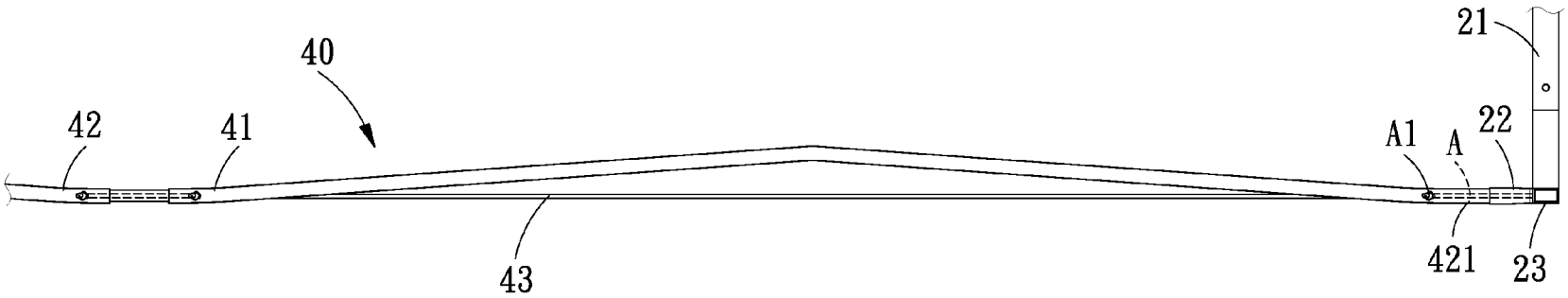
FIG. 7 is an amplified view of a part of the strengthened support structure for the net post assembly used in ball games in accordance with the present invention.
Figure 8:
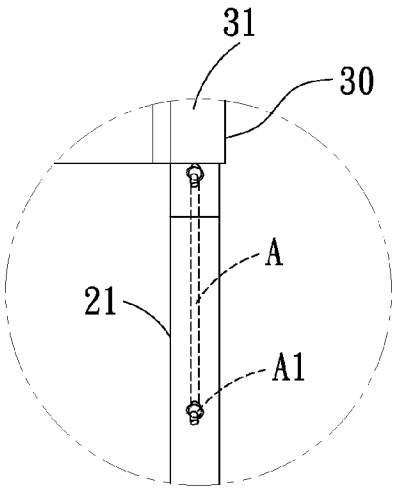
FIG. 8 is an amplified view of another part of the strengthened support structure for the net post assembly used in ball games in accordance with the present invention.

To connect two lower support units 40 together, the inserting head 421 of the second support section 42 of a first lower support unit 40 is inserted into the engaging portion 411 of the first support section 41 of a second lower support unit 40, and then an elastic rope A is inserted through the hole 422 of the second support section 42 of the first lower support unit 40 and the hole 412 of the first support section 41 of the second lower support unit 40, after that, each of two ends of the elastic rope A is tied into a knot A1 and stopped against the outer surface of the second support section 42 of the first lower support unit 40 and the first support section 41 of the second lower support unit 40, respectively. The hollow engaging portion 411 of the first support section 41 of the lower support unit 40 makes it easy to quick insert the elastic rope A and the elastic rope A makes it possible to fold the lower support units 40 against one another. In this way, a plurality of lower support units 40 can be connected together and can be packed in a folded manner. When the plurality of lower support its 40 is connected together into a chain structure, both ends of the chain structure can be jointed to the support pipes 221 of the support seats 22 of the two lateral support rod assemblies 20, so that the plurality of lower support units 40 is connected between the two lateral support rod assemblies 20, and the lower support units 40 and the support seats 22 of the two lateral support rod assemblies 20 are also connected by the elastic rope A, as shown in FIG. 3. In the present embodiment, a plurality of lower support units 40 is used to connect the two lateral support rod assemblies 20, so that the lower support units 40 can be packed in sections after being disassembled, thus reducing the storing space. The number of the lower support units 40 can also be changed as desired.

The above mentioned is the structural relation of the components of the strengthened support structure for a net post assembly used in ball games in accordance with the present invention. The plurality of lower support units 40 is connected between the two lateral support rod assemblies 20, and each of the lower support units 40 is an arc-shaped structure instead of a straight and flat rod. Therefore, when the two lateral support rod assemblies 20 are subjected to a stress, the stress will be equally distributed over the lower support units 40, and each of the lower support units 40 acts as an independent stress-sharing structure. Furthermore, the angle defined between the first support section and the second support section of the respective lower support units 40 strengthen the structural strength of the respective lower support units 40 and prevent the lower support units 40 from sagging down toward the middle thereof. In addition to that, the support body 43 between both ends of each of the lower support units 40 further improves the structural strength of the respective lower support units 40. By such arrangements, the net 30 disposed between the two lateral support rod assemblies 20 can be maintained in a tensioned condition which conforms to the design standard.

Figure 9:
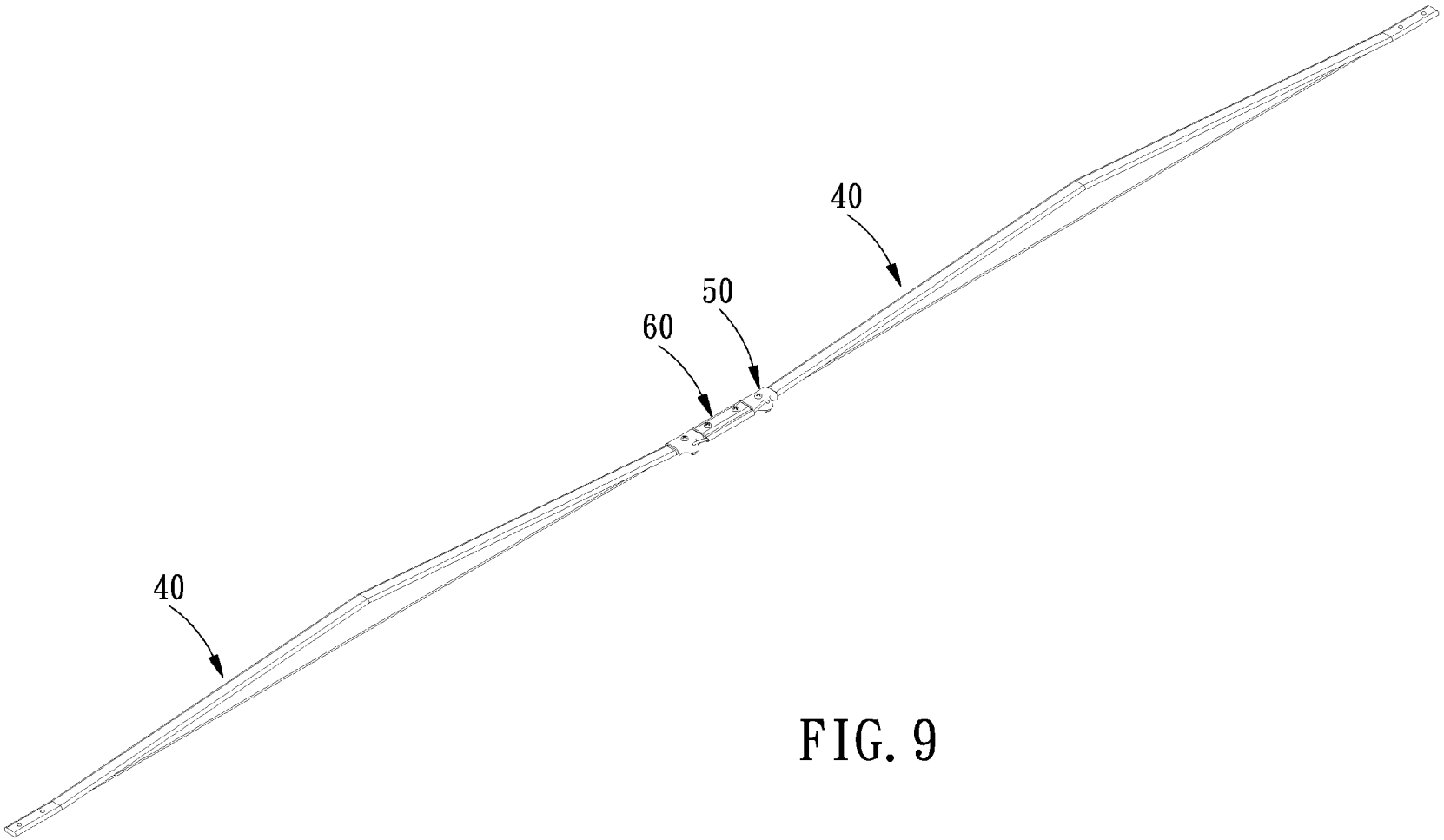
FIG. 9 is a perspective view showing the lower support unit in accordance with a second preferred embodiment of the present invention.
Figure 10:
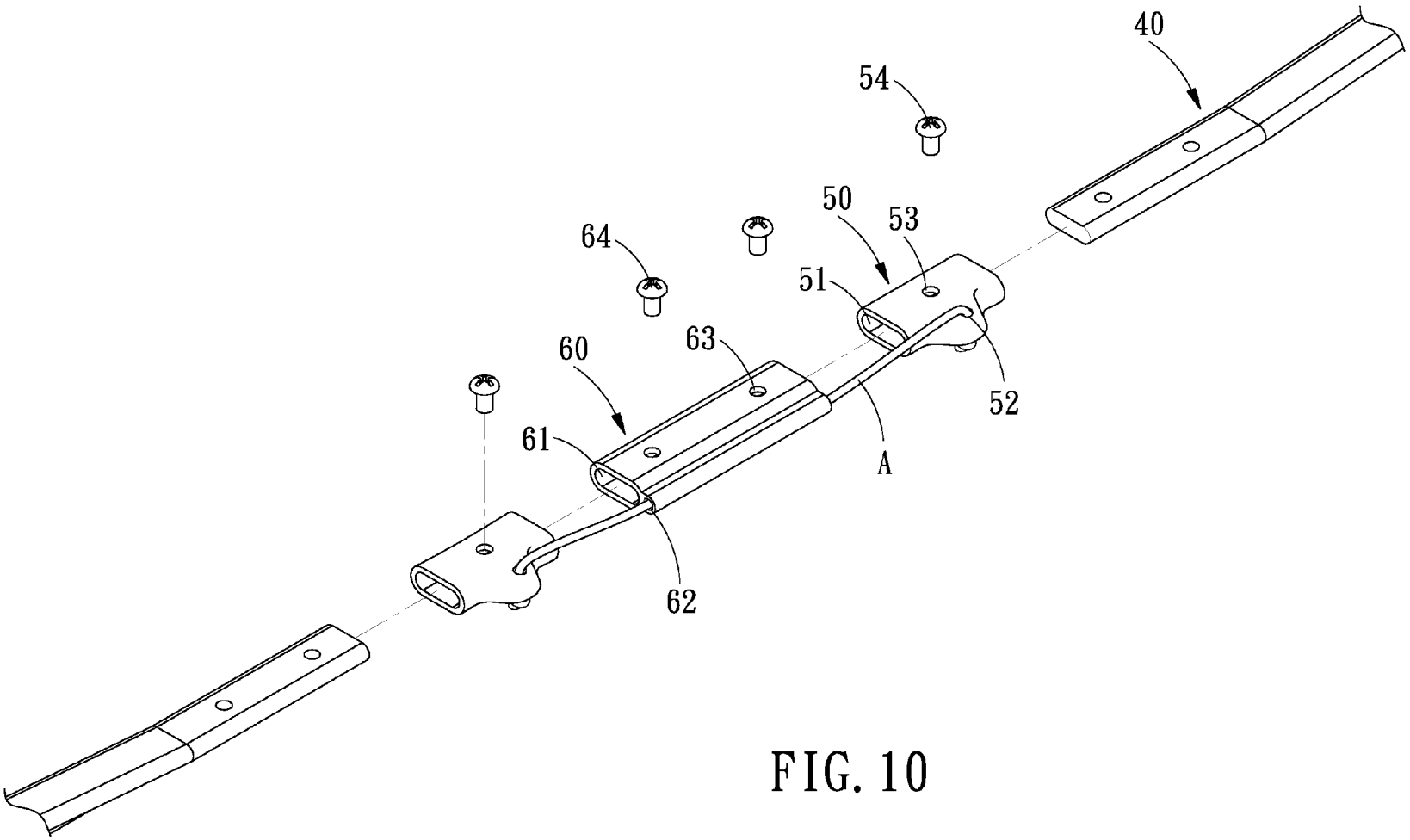
FIG. 10 is an exploded view showing the lower support unit in accordance with the second preferred embodiment of the present invention.
Figure 11:
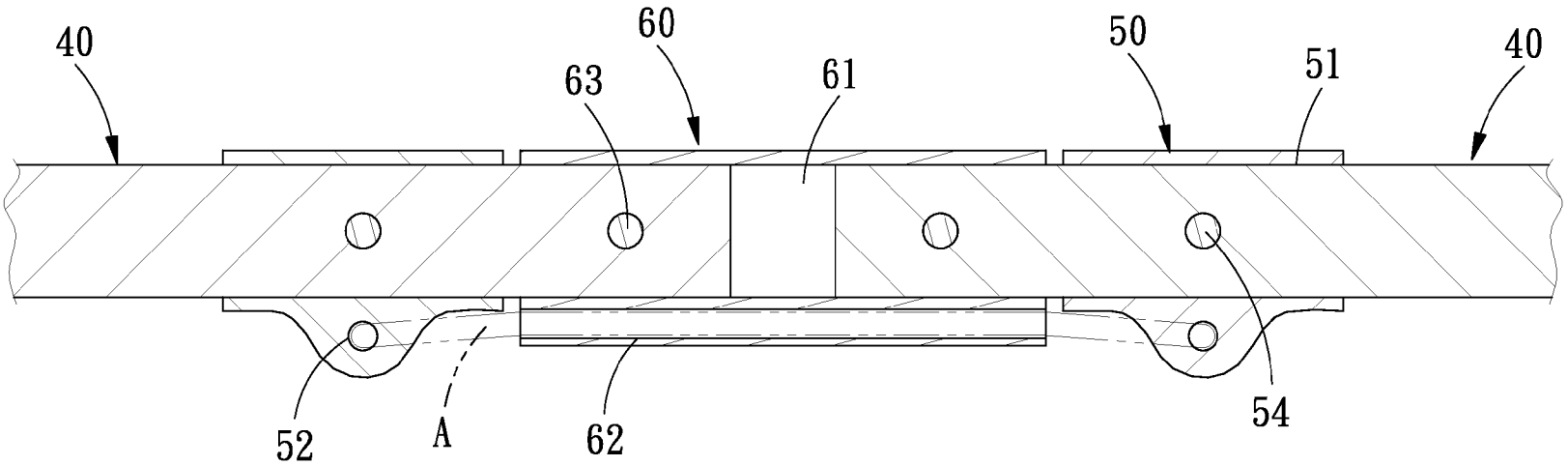
FIG. 11 is a cross sectional view showing the lower support unit in accordance with the second preferred embodiment of the present invention.

The abovementioned lower support units 40 are hollow structure which can be made of metal, plastic or other materials. According to a second embodiment of the present invention, as shown in FIGS. 9-11, the lower support units 40 can also be solid rods made of carbon fibers. Both ends of the respective lower support units 40 are provided with a fixing sleeve 50 which is formed with an engaging hole 51 for engaging with the ends of the lower support units 40. The fixing sleeve 50 is further formed with a through hole 52 and a locking hole 53. Each of two ends of the respective lower support units 40 is inserted in the engaging hole 51 of the fixing sleeve 50, and then a screw 54 is inserted through the locking hole 53 and pressed against the lower support unit 40, so that the fixing sleeves 50 are fixed to the ends of the respective lower support units 40. After that, two lower support units 40 equipped with the fixing sleeves 50 can be connected together by a connecting member 60 which is provided with an engaging hole 61 for insertion of the ends of the lower support units 40, an inserting hole 62 beside the engaging hole 61 for passage of elastic rope, and threaded holes 63 adjacent to both ends thereof. The fixing sleeves 50 fixed to the lower support units 40 are inserted in the engaging holes 61 of the connecting member 60 and then screws 64 are screwed through the threaded holes 63 and pushed against the lower support units 40. Meanwhile, an elastic rope A is inserted through the through hole 52 of the fixing sleeve 50 at a first end of the connecting member 60, the inserting hole 62 of the connecting member 60, and the through hole 52 of the fixing sleeve 50 at a second end of the connecting member 60, respectively, and finally tied into knots, such that the lower support units 40 in the form of solid rods can be connected one another by fixing sleeves 50 and connecting members 60.

With the lower support units 40 disposed at the bottom of the net, the two lateral support rod assemblies 20 can be stably propped up. Furthermore, each of the lower support units 40 acts as an independent stress-sharing structure, so that stress can be equally distributed over the lower support units 40. The angle defined by the first support section and the second support section cooperate with the support body 43 to strengthen the structural strength of the respective lower support units 40, which maintains the distance between the two lateral support rod assemblies 20 constant.

While we have shown and described various embodiments in accordance with the present invention, it is clear to those skilled in the art that further embodiments may be made without departing from the scope of the present invention.

What is claimed is:

1. A strengthened support structure for a net post assembly used in ball games, comprising:

two lateral support rod assemblies being oppositely arranged and spaced by a distance, between the two lateral support rod assemblies being disposed a net; and a plurality of lower support units each including a first support section and a second support section and a support body, a first end of the first support section being connected to a first end of the second support section to define an angle between the first and the second support sections, and a second end of the first support section being connected to one end of the support body and a second end of the second support section being connected to another end of the support body, the lower support units being connected in series in such a manner that the second end of the first support section of one of the lower support units is connected to the second end of the second support section of another lower support unit, a first one of the plural connected lower support units has a second end connected to a lower end of one of the lateral support rod assemblies, and a last one of the plural connected lower support units has a second end connected to a lower end of the other of the later support rod assemblies.

2. The strengthened support structure for a net post assembly used in ball games as claimed in claim 1, wherein a lower end of each of the lateral support rod assemblies is provided with a support seat, each of the support seats includes four support pipes that are in communication with one another, and one of the four support pipes of each of the support seats vertically extends upwards to be connected to the lower end of the lateral support rod assemblies, and the remained three support pipes are connected together into T shape at the lower end of the one of the four support pipes that vertically extends upwards in such a manner that two of the three support pipes, an angle between which is 180°, are connected to two lower support rods, and the remained one is connected to the lower support unit.

3. The strengthened support structure for a net post assembly used in ball games as claimed in claim 2, wherein each of the lateral support rod assemblies includes a plurality of connected rods, the support seats, the rods and the lower support rods are connected by an elastic rope.

4. The strengthened support structure for a net post assembly used in ball games as claimed in claim 3, wherein the lower support units as claimed in claim 3 and wherein the support seats are connected by the elastic rope.

5. The strengthened support structure for a net post assembly used in ball games as claimed in claim 1, wherein the lower support units are hollow pipes.

6. The strengthened support structure for a net post assembly used in ball games as claimed in claim 1, wherein the lower support units are hollow pipes, the second end of the first support section is formed with a hollow engaging portion, the second end of the second support section is formed with an inserting head corresponding to the engaging portion, the first support section is formed with a hole, the second support section is formed with a hole, to connect two lower support units together, the inserting head of the second support section of a first lower support unit is inserted into the engaging portion of the first support section of a second lower support unit, and then an elastic rope is inserted through the hole of the second support section of the first lower support unit and the hole of the first support section of the second lower support unit, after that, each of two ends of the elastic rope is tied into a knot and stopped against an outer surface of the second support section of the first lower support unit and the first support section of the second lower support unit, respectively.

7. The strengthened support structure for a net post assembly used in ball games as claimed in claim 1, wherein the support body is steel rope or non-steel rope.

8. The strengthened support structure for a net post assembly used in ball games as claimed in claim 1, wherein each of the lower support units is a solid rod.

9. The strengthened support structure for a net post assembly used in ball games as claimed in claim 8, wherein a fixing sleeve formed with an engaging hole for engaging with the lower support units is fixed to each of two ends of the respective lower support units, the fixing sleeve is further formed with a through hole and a locking hole, each of the two ends of the respective lower support units is inserted in the engaging hole of the fixing sleeve, and then a screw is inserted through the locking hole and pressed against the lower support unit, so that the fixing sleeves are fixed to the respective lower support units, after that, two lower support units equipped with the fixing sleeves are connected together by a connecting member which is provided with an engaging hole for insertion of the ends of the lower support units, an inserting hole beside the engaging hole for passage of elastic rope, and threaded holes, the fixing sleeves fixed to the lower support units are inserted in the engaging holes of the connecting member and then screws are screwed through the threaded holes and pushed against the lower support units, and an elastic rope is inserted through the through hole of the fixing sleeve at a first end of the connecting member, the inserting hole of the connecting member, and the through hole of the fixing sleeve at a second end of the connecting member, respectively, and finally tied into knots.

10. The strengthened support structure for a net post assembly used in ball games as claimed in claim 9, wherein the support units are made of carbon fibers.

* * * * *